United States Patent [19]

Boedecker

[11] 3,994,417

[45] Nov. 30, 1976

[54] TOWELETTE DISPENSER

[75] Inventor: Steven M. Boedecker, McHenry, Ill.

[73] Assignee: Colgate-Palmolive Company, New York, N.Y.

[22] Filed: June 2, 1975

[21] Appl. No.: 583,063

[52] U.S. Cl. ..... 221/48; 221/63
[51] Int. Cl.² ..... B65H 1/04
[58] Field of Search ..... 221/63, 48, 52, 45, 221/46; 206/409, 205; 118/43

[56] References Cited

UNITED STATES PATENTS

| | | | |
|---|---|---|---|
| 3,266,665 | 8/1966 | Eakens | 221/48 |
| 3,269,593 | 8/1966 | Lodewick et al. | 221/63 |
| 3,368,522 | 2/1968 | Cordis | 118/43 |
| 3,836,044 | 9/1974 | Tilp et al. | 221/63 |
| 3,836,045 | 9/1974 | Duhy et al. | 221/63 |

FOREIGN PATENTS OR APPLICATIONS

| | | | |
|---|---|---|---|
| 189,705 | 6/1965 | Sweden | 221/63 |

*Primary Examiner*—Stanley H. Tollberg
*Attorney, Agent, or Firm*—Powell L. Sprunger

[57] ABSTRACT

A dispenser for premoistened towelettes comprising, a container having a cavity, and opening means for passage of the towelettes from the cavity toward the outside of the container. The dispenser has a supply of premoistened absorbent material disposed in the container cavity. The dispenser also has a floating barrier movably positioned in the cavity intermediate the supply and the opening means, with the barrier having aperture means for passage of the supply through the barrier to the opening means.

17 Claims, 10 Drawing Figures

TOWELETTE DISPENSER

BACKGROUND OF THE INVENTION

The present invention relates to dispensers, and more particularly to dispensers for premoistened towelettes.

An assortment of devices have been proposed for dispensing premoistened towelettes. In such devices, a supply of the moist towelettes is normally retained in a receptacle, and the towelettes may be withdrawn from the receptacle for various uses. Of course, the towelettes should be protected in some manner from undue exposure to the atmosphere, in order to prevent evaporation of the moistening medium and drying out of the towelettes.

In one form of the devices, the container may have a relatively small opening through which the towelettes are withdrawn to provide a moisture retaining enclosure for the towelettes. However, such a container structure normally hinders access to the towelettes, and may prevent satisfactory use of the dispenser. For example, it may be desirable to store the dispenser with the towelettes unthreaded in the container opening prior to use for moisture retention purposes, in which case the towelettes must be threaded into the opening preparatory to use. Also, threading continuity of the towelettes may be occasionally lost during use of the dispenser, and the towelettes must then be rethreaded through the opening for subsequent use. In each case, the threading operation may be relatively difficult for the user, or may be impossible in certain prethreaded dispensers without breakage of the container. Additionally, it is desirable that the dispensers provide a smooth operation in removing towelettes from the container, and as noted above, that the dispensers maintain the towelettes in their premoistened condition.

SUMMARY OF THE INVENTION

The principal feature of the present invention is the provision of a dispenser for premoistened towelettes of simplified construction, and which provides ready access to the towelettes for threading the towelettes to an outside of the dispenser.

The dispenser of the present invention comprises, a container having a base, a top portion, and sidewalls extending from the base toward the top portion. The base and sidewalls at least partially define a cavity to eceive the towelettes, and the top portion has an opening for passage of the towelettes from the cavity toward the outside of the container. The dispenser has a supply of premoistened absorbent material disposed in the container cavity. The dispenser also has a floating barrier comprising a sheet of flexible material positioned in the container cavity intermediate the supply and the container opening, with the barrier being sufficiently large to extend across the opening. The barrier is movable between an upper position in the cavity below the opening and a lower position adjacent the supply, with the barrier having aperture means in alignment with the opening for passage of the supply through the barrier to the opening.

Thus, a feature of the present invention is that the barrier may be removed through the container opening to thread the supply through the aperture means of the barrier, after which the barrier may be replaced in the container cavity.

A feature of the present invention is that the threading operation may be accomplished in a quick and simplified manner.

Another feature of the invention is that the movable barrier provides for smooth and even dispensing of the supply from the container.

Yet another feature of the invention is that the barrier moves to its lower position adjacent the supply during nonuse of the dispenser, in order to reduce the volume of air surrounding the supply and limit loss of moisture from the towelettes.

A feature of the invention is that when the barrier is located at its lower position an end portion of the supply protruding through the barrier is recessed from the top of the dispenser, thus facilitating closure of a lid on the dispenser.

Further features will become more fully apparent in the following description of the embodiments of this invention and from the appended claims.

DESCRIPTION OF THE PREFERRED EMBODIMENTS

Figure 1:
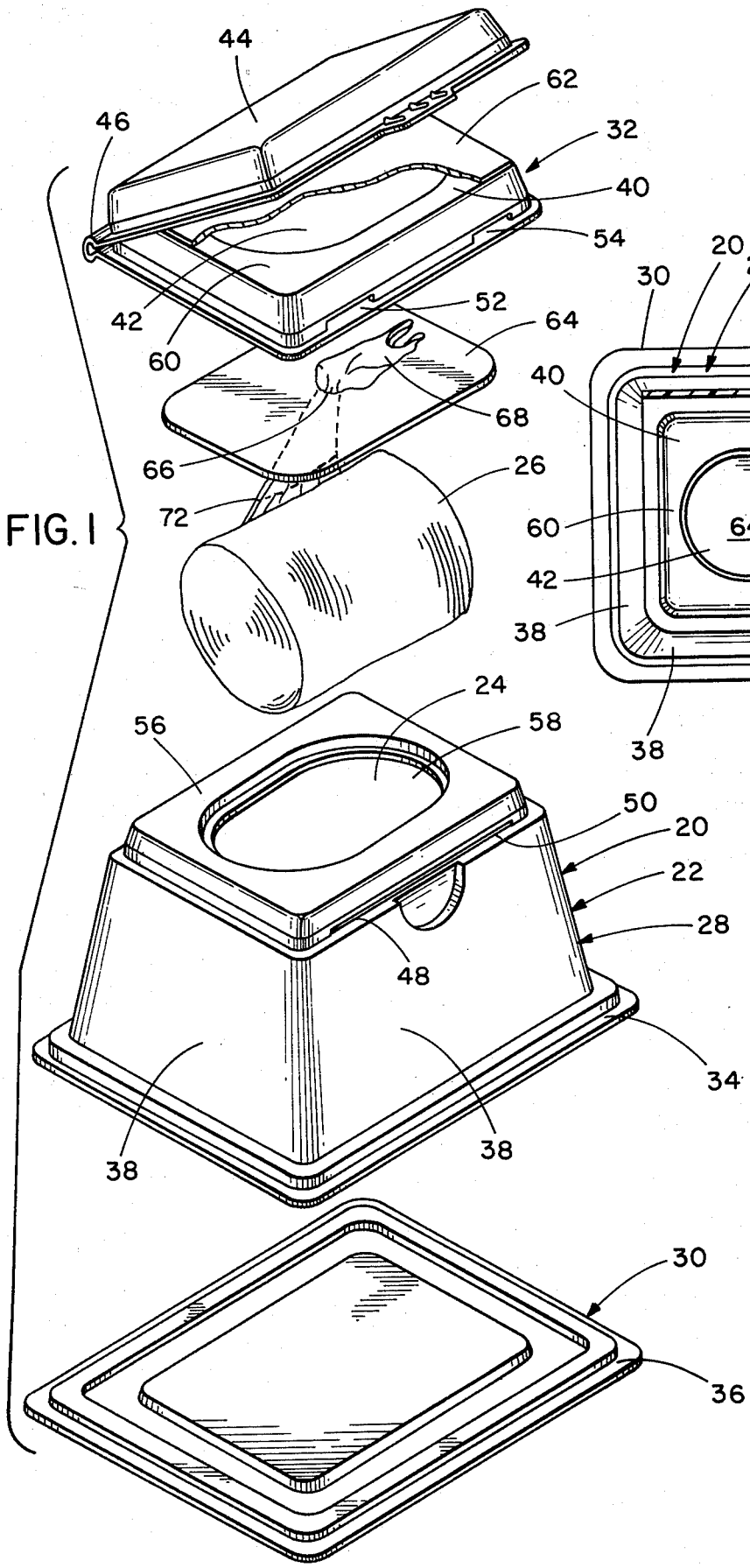
FIG. 1 is an exploded perspective view, partly broken away, showing a towelette dispenser of the present invention.
Figure 2:
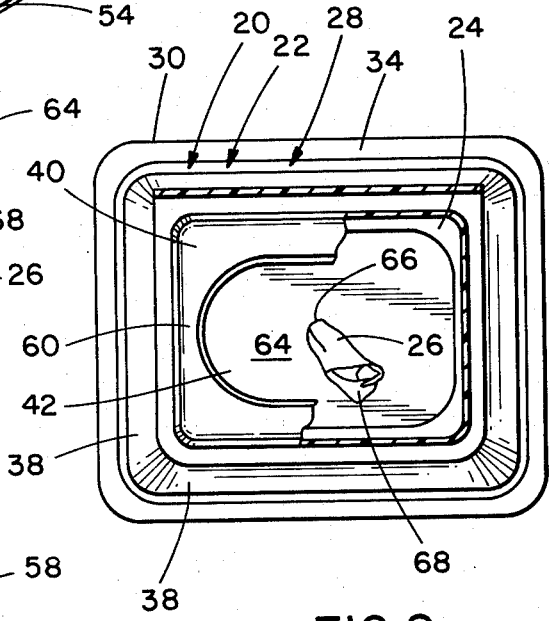
FIG. 2 is a top plan view, partly broken away, of the dispenser of FIG. 1.

Referring now to FIGS. 1–4, there is shown a dispenser generally designated 20 having a container 22 defining a cavity 24, and a supply 26 of premoistened towelettes disposed in the container cavity 24. The container 22 may be made of any suitable material, such as plastic, for example, a polyolefin such as polyethylene, or polypropylene, a polystyrene, an acrylate polymer, polyvinyl or polyvinylidene chloride, a polyester and the like. The preferred material is a thin polystyrene which is molded by conventional techniques, and is suitably inexpensive to be disposable after a single use. In this particular embodiment, the supply 26 comprises a premoistened web of an absorbent material which is wound into a roll, and in this particular embodiment, the web is preferably unrolled from its exterior during use of the dispenser, as shown. The supply 26 or roll may be impregnated with a variety of aqueous or non-aqueous solutions depending on the use desired. For example, the towelette may be impregnated with an aqueous soap or detergent solution which optionally may contain humectants, lanolin, perfumes, and the like. The web may be perforated perpendicular to its longitudinal axis along lines 72 at spaced intervals to provide individually removable towelette portions. The web may be of single thickness or may be folded parallel to the longitudinal axis of the web to provide a plurality of thicknesses, double with a single fold, triple with a double fold, etc. The web may be made of a non-woven fibrous cellulosic or synthetic material, as desired.

The dispenser 20 may comprise a body member 28, a base 30, and a top 32. The base 30 may be fitted or adhered, such as by heat or ultrasonic sealing, to the body member 28 to form the lower portion of the container 22. Thus, the body member 28 has an outwardly directing flange 34 extending peripherally around its lower end, and the base 30 has a flange 36 which cooperatively engages with the flange 34 of the body member 28. The flanges 34 and 36 may be heat or ultrasonically sealed together to close the lower portion of the container 22. The container 22 also has a plurality of sidewalls 38 which are preferably inclined from the base 30 toward an upper portion of the container, with the sidewalls 38 and the base 30 at least partially defining the container cavity 24.

The top 32 may comprise a double top having an inner member 40 defining an opening or opening means 42, and an outer top member or lid 44. As shown, the two portions of the top are connected by a C-shaped hinge 46, with the hinge extending from both the inner and outer top members 40 and 44, respectively. The hinge 46 prevents loss of the lid 44 and provides a continuous vapor seal at the hinge.

As initially provided to the consumer, the dispenser 20 is assembled with the supply or roll 26 contained in the cavity 24 of the body member 28, and with the top 32 press-fit thereon. Cooperative snap-fit means are provided in the body member and top comprising, positive lock indentations 48 and 50 in the body member 28 which are adapted to receive corresponding bosses 52 and 54 formed in the inner top member 40 of the top 32. The snapfit means may be provided along a plurality of the sidewalls of the body member and the inner top member walls, as desired. This structure provides a keyed fit of the top onto the top-receiving portion of the body. If desired, the inner top member 40 may optionally be adhered to the body member for a single-use, disposable dispenser.

As shown, the body member 28 has an upper wall 56 defining an opening or opening means 58. When the top 32 is snap-fit onto the body member 28, a wall 60 of the inner top member 40 overlies the wall 56 of the body member 28, with the openings 58 and 42 of the walls 56 and 60 being in alignment.

The dispenser 20 may have a fluid impervious sheet 62 which is releasably attached to one of the walls 60 or 56 in order to prevent moisture loss prior to use of the dispenser. If the inner top member 40 is sealed to the body member 28, the sheet 62 is releasably attached to the wall 60 of the inner top member 40, such that the sheet 62 covers the openings 58 and 42, as shown. Alternatively, if the top 32 is snap-fit into the body member 28, the sheet 62 may be releasably attached to the wall 56 such that the sheet 62 covers the opening 58. The sheet 62 may be made of any suitable material, and may be adhered or heat sealed to the appropriate wall.

Figure 3:
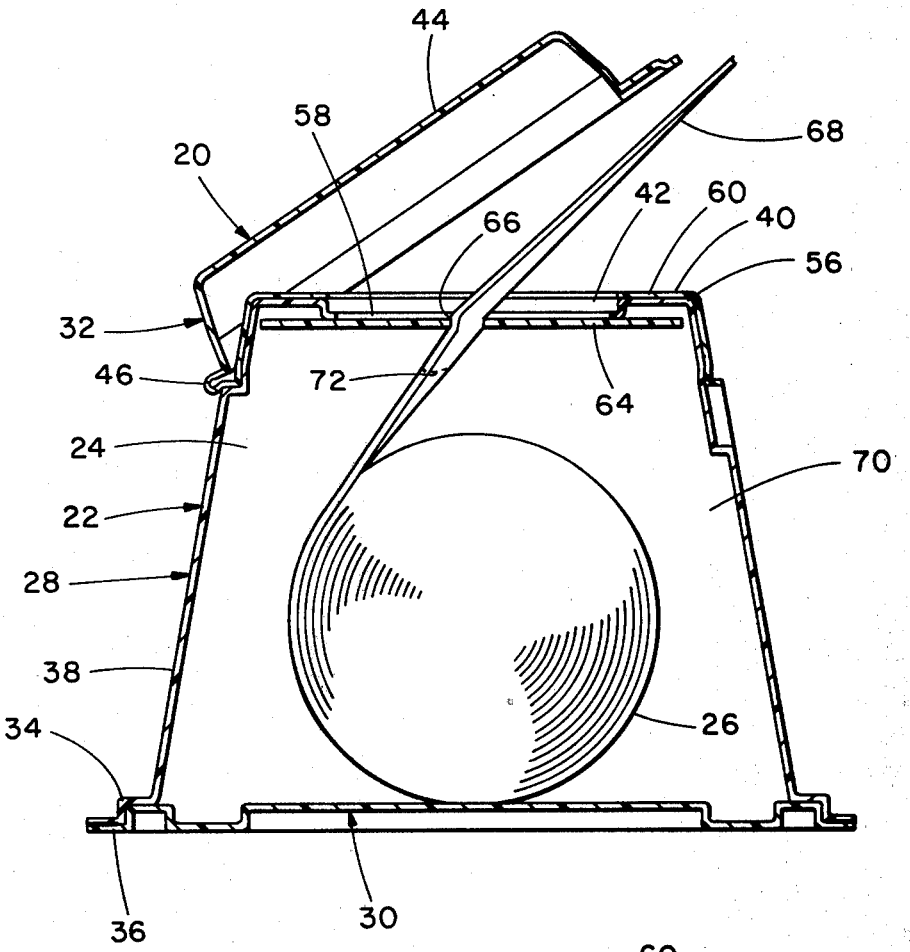
FIG. 3 is a side sectional view of the dispenser of FIG. 1 showing a premoistened towelette being withdrawn from the dispenser.
Figure 4:
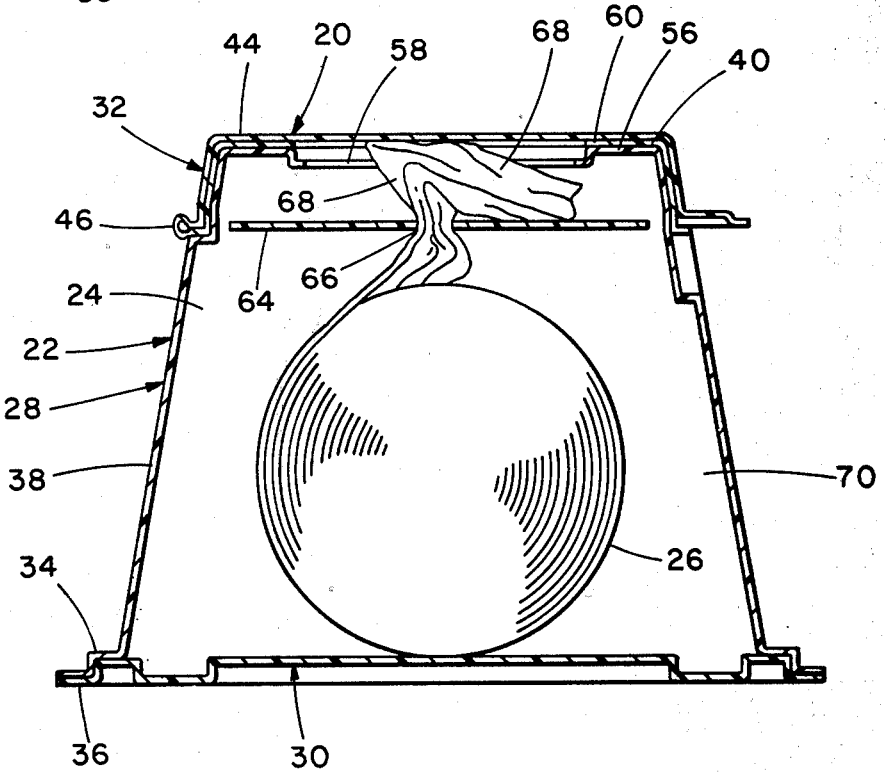
FIG. 4 is a side sectional view of the dispenser of FIG. 1 showing a lid on the dispenser closed between uses of the dispenser.

The dispenser also has a barrier or insert 64 positioned in the cavity 24 of the container intermediate the supply 26 and the opening means of the dispenser. The barrier 64 is preferably made from a sheet of flexible material, such as polyethylene, and has aperture means 66 extending through the barrier 64 to receive an end 68 of the supply 26, such that the supply 26 may be withdrawn through the aperture means 66 toward an outside of the container. In this particular embodiment, the aperture means 66 comprises a generally circular opening, and, in a preferred form, the aperture means is sufficiently small to snugly receive the end 68 of the supply 26. In a preferred embodiment, the barrier means 64 has slightly larger dimensions than the container opening means, in order that the barrier will normally remain in the container cavity 24. As best shown in FIGS. 3 and 4, the barrier 64 and container define a variable sized chamber 70 for retention of the supply 26 within the container.

As supplied to the consumer, the roll 26 of towelettes is positioned in the cavity 24 of the container, and the top 32 is snap-fit on the body member 28, with the lid 44 being closed. As previously discussed, the sheet 62 is releasably secured to the wall 60 of the inner top member 40 or the wall 56 of body member 28 if the top 32 is releasably attached to the body member 28, in order to prevent loss of moisture prior to use of the dispenser. The supply 26 may be prethreaded through the aperture means 66 of the barrier 64, or may be unthreaded, as desired. Prior to use of the dispenser, the user removes the sheet 62 from the inner top member 40 to provide access to the towelettes. If the supply 26 is unthreaded in its initial configuration, the barrier 64 may be removed from the container, as will be further described below, in order to thread the supply end 68 through the aperture means 66 of the barrier 64.

Assuming that the supply 26 has been threaded through the barrier aperture means 66, the user may open the lid 44 of the dispenser for access to the end 68 of the roll 26. The user may pull on the end 68 of the supply 26 to remove the web through the aperture means 66. When a sufficient amount of the supply has been removed from the dispenser, the user may tug sharply on the supply end 68 to tear the web along a perforation 72 in the web. As shown in FIG. 3, since tension is applied to the towelettes during removal of the supply from the dispenser, the barrier 64 moves to an upper position in the cavity where it engages against a lower part of the wall 60 surrounding the opening 42, and the chamber 70 is enlarged during this time. Thus, the container wall 60 prevents passage of the barrier 64 through the opening means, and the device permits even dispensing of the supply from the container when the barrier moves from its lower position in the cavity to its upper position at which time the supply is removed from the dispenser. Additionally, the relatively small aperture means 66 snugly engages the towelettes as they pass through the barrier 64 to facilitate smooth dispensing of the supply from the container, and normally prevents the towelettes from becoming unthreaded from the barrier aperture means.

When the outermost towelette has been severed from the remainder of the roll and tension has been released from the supply 26, the barrier 64 moves toward its lower position in the cavity adjacent the supply 26, as shown in FIG. 4, thus reducing the size of the chamber 70. In this configuration, the end 68 of the supply 26 is sufficiently spaced from the upper portion of the container to prevent obstruction with the lid when it is closed. Additionally, the barrier 64 continuously moves to lower positions in the container as the supply of towelettes in the dispenser dwindles during use, and the size of the chamber 70 continuously decreases after each use of the dispenser. Thus, the effective amount of air in the chamber 70 is continuously reduced to minimize the rate of evaporation from the premoistened towelettes.

Figure 5:
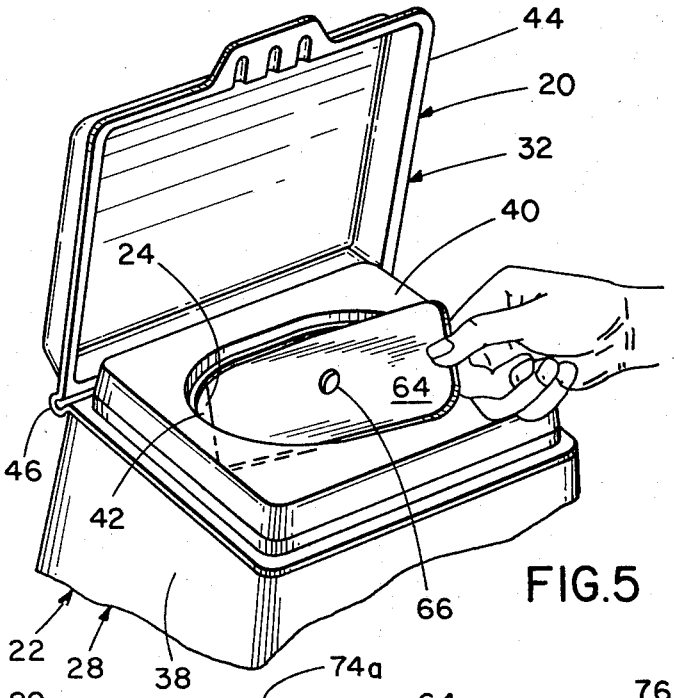
FIG. 5 is a fragmentary perspective view showing a barrier in the dispenser being removed for threading of the towelettes through an aperture in the barrier.

In the event that the dispenser is supplied to the consumer with the outer end 68 of the supply 26 unthreaded through the aperture means 66 of the barrier 64, or in the event that the supply 26 should inadvertently become lost from the aperture means during use of the dispenser, the supply may be readily threaded or rethreaded through the barrier aperture means 64 in the following manner. In a preferred form, the openings 58 and 42 are sufficiently large to receive the user's fingers or hand to provide easy access to the cavity 24 in the container. Thus, the user may grasp an edge of the barrier 64, and flex the barrier 64 slightly to remove the barrier or insert 64 from the container, as shown in FIG. 5. Once the barrier 64 has been removed from the container, an end of the supply 26 may be brought through the openings 58 and 42 of the dispenser and passed through the aperture means 66 of the barrier 64. After the supply has been threaded through the aperture means 66, the barrier 64 may be flexed slightly and reinserted into the container cavity through the openings 42 and 58, such that it is again positioned intermediate the supply 26 and the opening means for further dispensing of the supply from the container. Of course, the barrier 64 may be made of a relatively rigid material, if desired. In this case, the shape of the barrier 64 and the shape of the container openings may be selected such that the barrier 64 may be turned within the container cavity 24 until an end of the barrier may be removed from the opening means. For example, the generally rectangular shaped barrier 64, as shown in FIG. 5, may be removed in this manner through the elongated opening means in the upper portion of the dispenser without flexation of the barrier 64.

Figure 7:
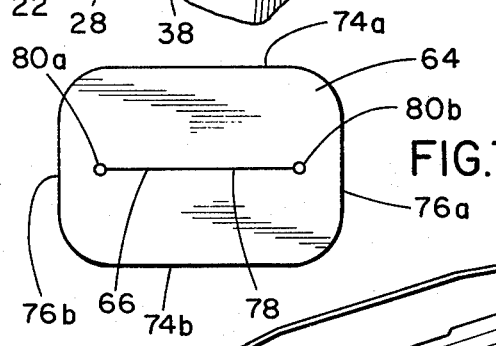
FIG. 7 is a top plan view of one embodiment of a barrier for the dispensers of the present invention.
Figure 8:
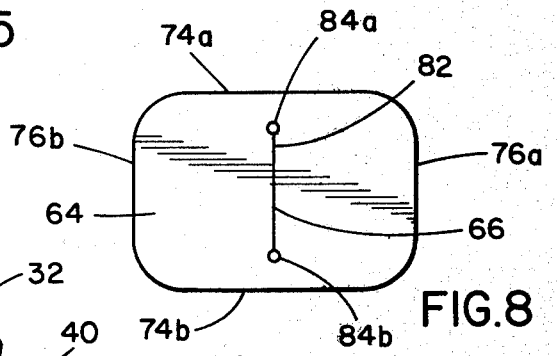
FIG. 8 is a top plan view of another embodiment of the barrier for the dispensers of the present invention.
Figure 9:
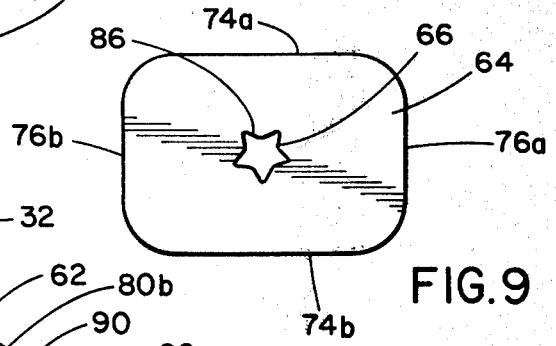
FIG. 9 is a top plan view of another embodiment of the barrier for the dispensers of the present invention.

Further embodiments of the barrier means 64 for the dispenser of the present invention is illustrated in FIGS. 7–9, in which like reference numerals designate like parts. As shown, the barrier 64 may have a generally rectangular shape with a pair of side edges 74*a* and 74*b* and a pair of end edges 76*a* and 76*b* connecting the side edges 74*a* and *b*. As shown in FIG. 7, the aperture means 66 may comprise a slit 78 extending longitudinally in the barrier 64, with a pair of apertures 80*a* and 80*b* being located at opposibe ends of the slit 78. A similar aperture means 66 is illustrated in FIG. 8, in which the barrier 64 has a lateral slit 82 and apertures 84*a* and 84*b* located at the ends of the slit 82. The barriers 64 of FIGS. 7 and 8 may be used in a manner similar to that described in connection with the barrier means of FIGS. 1–5. The supply 26 freely passes through the slits 78 and 82 of the barriers for dispensing the source 26 from the container, and the towelettes may be drawn against the openings at the ends of the slits which provides frictional engagement for the supply to sever perforations in the web or to firmly retain towelettes at the ends of the slit between uses of the dispenser. The barrier 64 of FIG. 9 has a generally star-shaped opening 86 which may have relatively sharp or rounded corners and any number of points, as desired. The edges of the opening 86 engage the towelettes in a firm manner to provide smooth dispensing of the supply 26 from the container, and permit removal of one towelette from the dispenser at a time.

Figure 6:
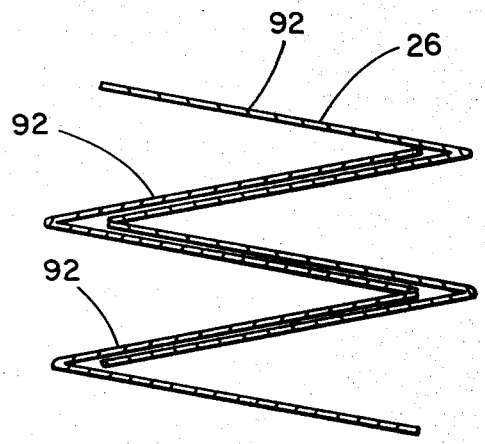
FIG. 6 is a sectional view of interleaved towelettes for the dispensers of the present invention.
Figure 10:
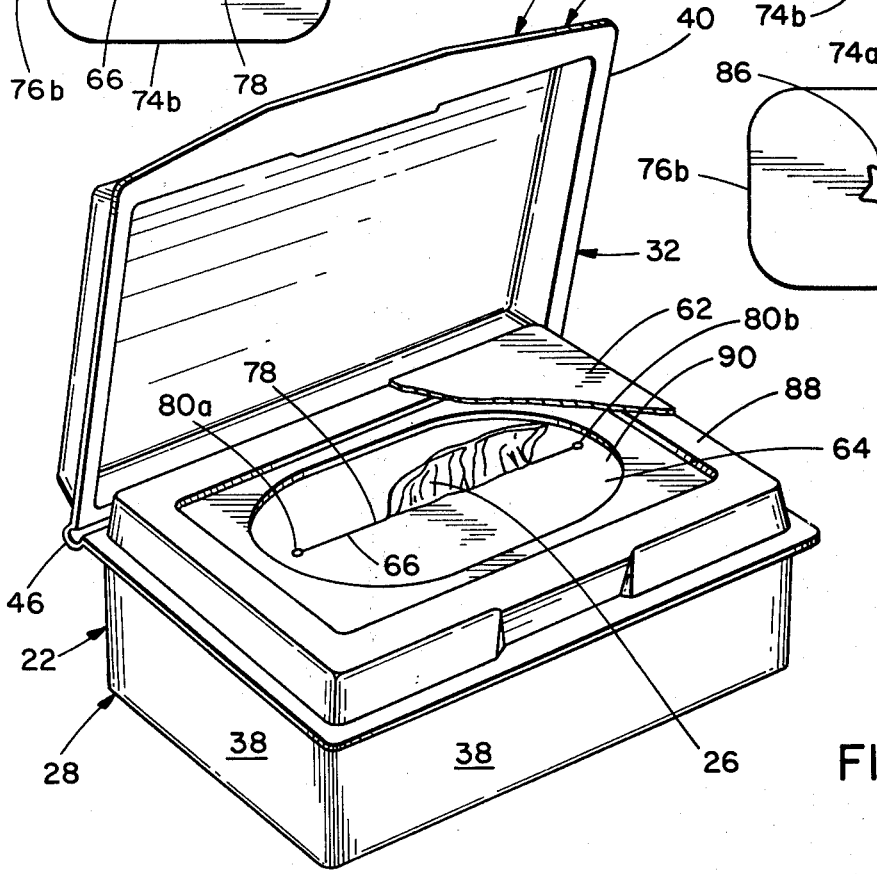
FIG. 10 is a perspective view, partly broken away, of another embodiment of the dispenser of the present invention.

Another embodiment of the dispenser 20 of the present invention is illustrated in FIG. 10, in which like reference numerals designate like parts. The dispenser 20 has a container which is similar to that described in connection with FIGS. 1–5, except that the base of the container may be integral with its sidewalls, and the top 32 may be heat sealed to the body member 28 of the container. Also, the container may have a single wall 88 defining the opening means 90 for removal of the towelettes from the dispenser, and may have vertical sidewalls 38. In a convenient form, the dispenser may have a barrier 64 similar to that described in connection with FIG. 7. Also, in a preferred form, the dispenser may have a smaller height than the dispenser described in connection with FIGS. 1–5, and the source 26 of towelettes may be formed from a plurality of absorbent sheets 92, as shown in FIG. 6, with ends of the sheets being interleaved. Thus, the source of interleaved sheets is positioned in the container cavity, with the barrier 64 being positioned intermediate the source 26 and the opening means 90. Of course, the source 26 of interleaved sheets may be utilized in the dispenser in connection with FIGS. 1–5.

The foregoing detailed description is given for clearness of understanding only, and no unnecessary limitations should be understood therefrom, as modifications will be obvious to those skilled in the art.

I claim:

1. A dispenser for premoistened towelettes, comprising:

a container having wall means of a liquid impervious material at least partially defining a cavity, and a wall portion defining opening means for passage of the towelettes from the cavity toward the outside of the container;

a supply of premoistened absorbent material disposed in the container cavity;

a floating barrier having dimensions larger than said opening means to obstruct against said wall portion during normal use of the dispenser, said barrier being movably positioned in the container intermediate said supply and said wall portion in alignment with the opening means, said barrier having aperture means for passage of the supply through the barrier to said opening means, and said barrier having sufficiently small dimensions and being proportioned relative the opening means to permit removal of the barrier through the opening means of said wall portion without enlargement of the opening means when said supply is substantially full; and cover means for selectively covering the opening means and sealing the cavity from the atmosphere.

2. A dispenser for premoistened towelettes, comprising:

a container having wall means of a liquid impervious material at least partially defining a cavity, an upper wall portion defining opening means for passage of the towelettes from the cavity toward the outside of the container, said opening means being sufficiently large to receive the user's fingers in the cavity;

a supply of premoistened absorbent material disposed in the container cavity;

a flexible barrier movably positioned in the cavity intermediate the supply and said upper wall portion in alignment with said opening means, said barrier being longer than the opening means in at least one direction to obstruct against said wall portion during normal use of the dispenser, said barrier having aperture means of substantially smaller dimensions than the opening means for passage of the supply through the barrier to said opening means, and said barrier having sufficiently small dimensions and being proportioned relative the opening means such that the barrier may be removed from the container through said opening means without removal of said wall portion when said supply is substantially full to thread the supply through the aperture means of the barrier; and a lid for selectively closing said opening means and sealing said cavity from the atmosphere.

3. A dispenser for premoistened towelettes, comprising:

a container having a base, an upper wall portion, and sidewalls extending from the base toward said upper wall portion, said base and sidewalls being constructed from a liquid impervious material and at least partially defining a cavity to receive the towelettes, and said upper wall portion having an opening for passage of the towelettes from the cavity toward the outside of the container, with said opening being sufficiently large to receive the user's fingers in the cavity;

a supply of premoistened absorbent material disposed in the container cavity;

a floating barrier comprising a sheet of flexible material positioned in the container cavity intermediate said supply and said container opening, said barrier having larger dimensions than said opening to obstruct against said upper wall portion during normal use of the dispenser and sufficiently small dimensions relative the sidewalls and opening to permit turning of the barrier to a transverse position in the container and permit removal of the barrier through the upper wall portion without enlargement of said opening, said barrier being movable between an upper position in the cavity below the opening and a lower position adjacent said supply, and said barrier having aperture means of substantially smaller size than the opening and in alignment with said opening for passage of the supply through the barrier to the opening, whereby the barrier may be removed from the container through the container opening to thread the supply through the barrier aperture means; and a lid adjacent an upper end of the container for releasably closing said opening and sealing the cavity from the atmosphere.

4. The dispenser of claim 3 wherein said sidewalls are inclined from the base toward said upper portion.

5. The dispenser of claim 3 wherein the aperture means is generally centrally located in said barrier.

6. The dispenser of claim 3 wherein the aperture means comprises an elongated slit in said barrier.

7. The dispenser of claim 6 wherein the aperture means includes a relatively small opening at each end of said slit.

8. The dispenser of claim 6 wherein the slit extends longitudinally in said barrier.

9. The dispenser of claim 6 wherein the slit extends laterally in said barrier.

10. The dispenser of claim 3 wherein the aperture means comprises a generally star-shaped opening in the barrier.

11. The dispenser of claim 3 wherein the aperture means comprises a generally circular aperture in the barrier.

12. The dispenser of claim 3 wherein said supply comprises a perforated roll of a web of absorbent material.

13. The dispenser of claim 3 wherein the supply comprises a plurality of interleaved sheets of absorbent material.

14. The dispenser of claim 3 including a sheet of fluid impervious material releasably sealed to the container across said opening with said sheet covering said opening to provide a fluid proof barrier prior to use of the dispenser.

15. The dispenser of claim 3 wherein the upper portion comprises, a lid assembly including an inner member having opening means for passage of the supply from the barrier to the outside of the container, means for releasably attaching the lid assembly to an upper end of the container, and a lid hinged to said inner member for releasably closing the opening means.

16. The dispenser of claim 15 wherein the container includes an upper wall defining second opening means generally aligned with the opening means of said inner member when the lid assembly is positioned on the container.

17. The dispenser of claim 3 wherein the upper portion comprises, an upper wall of the container defining said opening.

* * * * *